United States Patent [19]

Stolka et al.

[11] Patent Number: 4,758,487

[45] Date of Patent: Jul. 19, 1988

[54] ELECTROSTATOGRAPHIC IMAGING MEMBERS WITH AMORPHOUS BORON

[75] Inventors: Milan Stolka; Damodar M. Pai, both of Fairport, N.Y.

[73] Assignee: Xerox Corporation, Stamford, Conn.

[21] Appl. No.: 934,374

[22] Filed: Nov. 24, 1986

[51] Int. Cl.[4] ..... G03G 5/085

[52] U.S. Cl. ..... 430/57; 430/84; 430/95

[58] Field of Search ..... 430/57, 58, 66, 84, 430/95

[56] References Cited

U.S. PATENT DOCUMENTS

| | | | |
|---|---|---|---|
| 4,330,182 | 5/1982 | Coleman | 430/66 |
| 4,525,442 | 6/1985 | Shirai | 430/57 |

FOREIGN PATENT DOCUMENTS

| | | |
|---|---|---|
| 5857135 | 7/1982 | Japan . |
| 57-115558 | 7/1982 | Japan . |

*Primary Examiner*—John L. Goodrow

*Attorney, Agent, or Firm*—E. O. Palazzo

[57] ABSTRACT

Disclosed is a photoresponsive imaging member comprised of certain hydrogenated, or halogenated amorphous boron.

37 Claims, 1 Drawing Sheet

ELECTROSTATOGRAPHIC IMAGING MEMBERS WITH AMORPHOUS BORON

BACKGROUND OF THE INVENTION

This invention is generally directed to the use of hydrogenated and halogenated amorphous boron compositions as electrostatographic imaging members. More specifically, the present invention is directed to photoresponsive imaging members, including layered members comprised of hydrogenated amorphous boron, that possesses photoconductive properties. In one embodiment of the present invention there are provided photoconductive imaging members comprised of amorphous boron with a band gap of from about 1.0 to about 3 electron volts, and a hydrogen content of from about 5 atomic percent to about 30 atomic percent. Also encompassed within the present invention are layered photoconductive imaging members comprised of hydrogenated amorphous boron with photoconductive properties situated on a supporting substrate, and wherein the member further includes an overcoating layer. Moreover, there is provided in accordance with the present invention imaging members comprised of hydrogenated amorphous boron, and photoconductive hydrogenated amorphous silicon. Also, in another embodiment of the present invention, the photoconductive amorphous boron is present in the imaging member in a gradient as detailed hereinafter. The aforementioned imaging members are particularly useful in electrostatographic imaging processes; and further, in some configurations the imaging members of the present invention can be selected for xerographic printing systems.

Electrostatographic imaging systems, and particularly xerographic imaging processes are extensively described in the prior art. Generally, in these processes a photoconductive material is selected for forming the latent electrostatic image thereon. The photoreceptor can be comprised of a conductive substrate containing on its surface a layer of photoconductive material, and in many instances a thin barrier layer is situated therebetween to prevent charge injection from the substrate, which could adversely effect the quality of the resulting image. Examples of known useful photoconductive materials include amorphous selenium, alloys of selenium such as selenium tellurium, selenium arsenic, and the like. Additionally, there can be selected as the imaging member various organic photoconductive materials including, for example, complexes of trinitrofluorenone and polyvinylcarbazole. Recently, there has been disclosed layered organic photoresponsive devices with arylamine hole transport molecules and photogenerating layers, reference for example U.S. Pat. No. 4,265,990, the disclosure of which is totally incorporated herein by reference.

Also known are amorphous silicon photoconductors, reference for example U.S. Pat. No. 4,265,991 and 4,225,222. There is disclosed in the '991 patent an electrophotographic photosensitive member comprised of a substrate, and a photoconductive overlayer of amorphous silicon containing 10 to 40 atomic percent of hydrogen, and having a thickness of 5 to 80 microns. Additionally, this patent describes several processes for preparing amorphous silicon. In one process embodiment, there is prepared an electrophotographic photosensitive member which involves heating the member present in a chamber to a temperature of 50° C. to 350° C., introducing into the chamber a gas with silicon and hydrogen atoms, providing an electrical discharge in the chamber by electric energy to ionize the gas, wherein there is deposited amorphous silicon on the substrate at a rate of 0.5 to 100 Angstroms per second by utilizing an electric discharge thereby resulting in an amorphous silicon photoconductive layer of a predetermined thickness. Although the amorphous silicon device described in this patent is photosensitive, after a minimum number of imaging cycles, less than about 1,000 for example, unacceptable low quality images of poor resolution with many deletions may result. With further cycling, that is subsequent to 1,000 imaging cycles and after 10,000 imaging cycles, the image quality may continue to deteriorate often until images are partially deleted.

There are also illustrated in copending applications photoconductive imaging members comprised of amorphous silicon. Accordingly, for example, there is disclosed in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorous. Furthermore, described in copending application U.S. Pat. No. 4,544,617, entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer. Additionally, described in copending application U.S. Pat. No. 4,613,556, entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide. There is further disclosed in the latter copending application an interface transition gradient between the silicon oxide charge transport layer and the photogenerating layer.

Moreover, described in copending application U.S. Ser. No. 751,820 entitled Electrophotographic Imaging Members With Amorphous Carbon, the disclosure of which is totally incorporated herein by reference, are photoresponsive imaging members comprised of hydrogenated amorphous carbon, or halogenated amorphous carbon. More specifically, in accordance with the teachings of the aforementioned copending application there is illustrated a photoresponsive imaging member comprised of a supporting substrate, and in contact therewith hydrogenated amorphous carbon, or halogenated amorphous carbon with a band gap of from about 0.5 to about 5 electron volts.

Other representative prior art patents that disclose amorphous silicon imaging members include, for example, 4,357,179 directed to methods for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 4,359,514; 4,404,076; 4,403,026; 4,397,933; 4,416,962; 4,423,133; 4,461,819; 4,490,453;

4,237,151; 4,356,246; 4,361,638; 4,365,013; 3,160,521; 3,160,522; 3,496,037; 4,394,426; and 3,892,650.

Although the above-described amorphous silicon photoresponsive imaging members, including the compensated members, may be useful for their intended purposes, there continues to be a need for new imaging members. Also, there is a need for improved photoconductive materials which can be continuously used in a number of imaging cycles without deterioration therefrom. Additionally, there is a need for improved photoresponsive imaging members comprised of hydrogenated amorphous boron which are humidity insensitive and are not adversely effected by the electrical consequences resulting from scratching and abrasion. Moreover, there is a need for improved photoconductive imaging members comprised of hydrogenated amorphous boron which can be prepared with a minimum number of processing steps, and wherein the layers are sufficiently adhered to one another to enable the continuous use thereof in repetitive imaging and printing processes. Furthermore, there continues to be a need for halogenated amorphous boron photoconductive substances which can be selected for incorporation into electrostatographic imaging processes; and wherein these substances are not sensitive to humidity and corona ions generated by the charging apparatus thereby allowing the use thereof over a substantial number of imaging cycles without causing a degradation in image quality, and which members possess other desirable characteristics. In addition, there is a need for photoresponsive imaging members wherein hydrogenated amorphous boron can be selected as a transporting layer, and wherein the member further includes therein a photogenerating substance such as amorphous silicon. Additionally, there is a need for photoresponsive imaging members wherein the surface thereof is believed to be chemically more stable than hydrogenated amorphous silicon. There is also a need for a relatively nonhazordous process enabling the preparation of photoresponsive imaging members, wherein there can be selected diborone gases which are chemically more stable than silianes, or disilanes used in the generation of hydrogenated amorphous silicon imaging members.

SUMMARY OF THE INVENTION

It is therefore an object of the present invention to provide photoresponsive imaging members which overcome some of the above-noted disadvantages.

In yet another object of the present invention there are provided photoconductive imaging members comprised of hydrogenated amorphous boron.

In a further object of the present invention there are provided layered photoresponsive imaging members with amorphous boron as a photogenerating layer and a charge transporting component.

In a further object of the present invention there are provided layered photoresponsive imaging members with hydrogenated amorphous boron as a charge transporting substance.

Another object of the present invention resides in the provision of hydrogenated amorphous boron, and halogenated amorphous boron with photoconductive properties enabling their use, for example, in electrostatic imaging and printing processes.

Also, in a further object of the present invention there are provided photoresponsive imaging members with hydrogenated amorphous boron possessing a band gap of from about 1.0 to about 3 electron volts.

In still a further object of the present invention there are provided photoresponsive imaging members wherein hydrogenated amorphous boron with a band gap of from 1.0 to about 3 electron volts is present as a gradient therein.

Furthermore, an additional object of the present invention resides in photoconductive imaging members comprised of hydrogenated amorphous boron with n and/or p-type dopants, inclusive of phosphorous, silicon, arsenic, and nitrogen.

Another object of the present invention resides in the provision of hydrogenated amorphous boron, or halogenated amorphous boron as imaging members with overcoating layers.

Also, there is provided in accordance with the present invention hydrogenated, or halogenated amorphous boron photoconductors with overcoating layers such as those illustrated in U.S. Pat. No. 4,544,617, the disclosure of which is totally incorporated herein by reference, inclusive of silicon nitride, silicon carbide, and amorphous carbon.

Additionally, there are provided in accordance with the present invention layered photoresponsive imaging members comprised of hydrogenated amorphous boron optionally doped with substances such as germanium to enable photosensitivity in the infrared region of the spectrum.

Additionally, in further objects of the present invention there are provided imaging methods with photoconductive members containing therein as a component hydrogenated, or halogenated amorphous boron with photoconductive properties; and processes and apparatuses for affecting the preparation of hydrogenated amorphous boron substances.

These and other objects of the present invention are accomplished by the provision of photoconductors comprised of hydrogenated amorphous boron. More specifically, in accordance with the present invention there are provided photoresponsive imaging members comprised of hydrogenated, or halogenated amorphous boron possessing photoconductive properties. In one specific embodiment of the present invention there are provided photoresponsive imaging members comprised of hydrogenated or halogenated amorphous boron with a band gap of from about 1.0 to about 3 electron volts.

Another specific photoresponsive imaging member of the present invention is comprised of a supporting substrate, and thereover hydrogenated amorphous boron with a band gap of from about 1.0 to about 2.5 electron volts. In a further embodiment of the present invention there are provided photoresponsive imaging members comprised of a supporting substrate, in contact therewith a layer comprised of hydrogenated amorphous boron with a band gap of from 1.4 to 2 electron volts, and an optional top overcoating protective layer, which layer can be rendered partially conductive.

Additionally, encompassed within the scope of the present invention are photoresponsive imaging members comprised of a photogenerating layer such as hydrogenated amorphous silicon; and as a charge transport layer in contact therewith hydrogenated or halogenated amorphous boron. With respect to the aforementioned embodiment, the amorphous boron charge transport component can be situated between a supporting substrate and the photogenerating layer; or alternatively there is situated between the supporting substrate and the amorphous boron charge transport layer the photogenerating layer. The aforementioned imaging members may contain thereover protective overcoatings.

Moreover, there is included within the present invention photoresponsive imaging members comprised of a photogenerating layer of, for example, hydrogenated amorphous silicon; a charge transport layer of hydrogenated, or halogenated amorphous boron; and as an overcoating various known compositions inclusive of plasma deposited silicon nitride, plasma deposited silicon carbide, and amorphous carbon.

The photoresponsive or photoconductive members of the present invention can be incorporated into various imaging apparatuses wherein, for example, latent electrostatic images are formed, followed by development; subsequently transferring the developed image to a suitable substrate; and optionally permanently affixing the image thereto. Photoresponsive imaging members comprised of hydrogenated, or halogenated amorphous boron as illustrated herein, and with photoconductive properties when incorporated into the aforementioned apparatuses posses the desirable properties indicated enabling, for example, their use for an extended number, 100,000 for example, of imaging cycles. Moreover, the photoconductive imaging members of the present invention in certain configurations can be selected for use in xerographic printing processes, that is for example, wherein the member includes therein a component which is sensitive to the infrared region of the spectrum. Additionally, the photoresponsive imaging members of the present invention can be incorporated into imaging apparatuses, wherein there is selected for rendering the images visible a liquid development process.

BRIEF DESCRIPTION OF THE DRAWINGS

For a better understanding of the present invention and further features thereof, reference is made to the following description of various preferred embodiments wherein.

DESCRIPTION OF THE PREFERRED EMBODIMENTS

Figure 1:
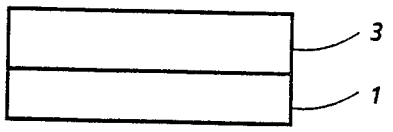
FIG. 1 is a partially schematic cross-sectional view of the photoresponsive imaging member of the present invention.

Illustrated in FIG. 1 is a photoresponsive imaging member of the present invention comprised of a supporting substrate 1, and a photogenerating/charge transport layer 3 in a thickness of from about 5 to about 25 microns; and comprised of hydrogenated amorphous boron possessing photoconductive properties. In this embodiment, the hydrogenated amorphous boron preferably has a band gap of about 2 electron volts.

Figure 2:
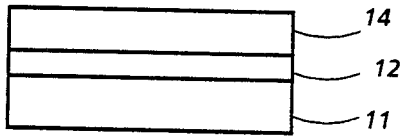
FIG. 2 is a partially schematic cross-sectional view of a further photoresponsive imaging member of the present invention.

Illustrated in FIG. 2 is a photoresponsive imaging member of the present invention comprised of a supporting substrate 11; a photogenerating/charge transport layer 12 in a thickness of from about 5 to about 25 microns, comprised of hydrogenated amorphous boron with a band gap of from about 1 to about 3.0 electron volts, and preferably 2 electron volts; and an optional top overcoating layer 14 in a thickness of from about 200 nanometers to about 1 micrometer comprised of, for example, silicon nitride, silicon carbide, or hydrogenated amorphous carbon with a band gap of 2 to 4 electron volts.

Figure 3:
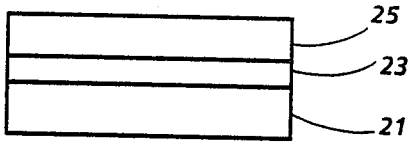
FIG. 3 illustrates another photoresponsive imaging member embodiment of the present invention.

Illustrated in FIG. 3 is a photoresponsive imaging member of the present invention comprised of a supporting substrate 21; a photoconductive layer 23 comprised of hydrogenated amorphous boron in a thickness of from about 5 to about 25 microns with a band gap of from 1 to 3 electron volts; and wherein the hydrogen is present in a gradient in an amount of from 0 percent in close proximity to the supporting substrate and extending to an amount of about 30 percent at the interface between the photoconductive layer, and preferably from 5 percent hydrogen to 15 percent hydrogen; and a top protective overcoating layer 25 in a thickness of from about 200 nanometers to 1 micrometer.

Figure 4:
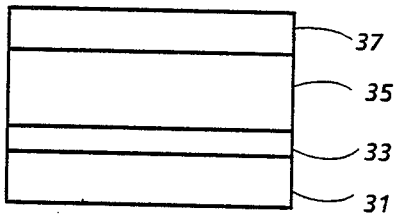
FIGS. 4 and 5 are partially schematic cross-sectional views of further photoresponsive imaging members encompassed by the present invention.

Illustrated in FIG. 4 is a photoresponsive imaging member of the present invention wherein the layers are substantially similar to those of FIGS. 1 to 3, which member is comprised of a supporting substrate 31; a hydrogenated amorphous silicon photoconductive layer 33 in a thickness of about 0.1 micron to 1 micron; a charge transport layer 35 of hydrogenated amorphous boron; and an optional overcoating 37 comprised of, for example, plasma deposited silicon nitride, silicon carbide, or amorphous carbon. Alternatively, with respect to the aforementioned imaging member of FIG. 4, there can be situated between the hydrogenated amorphous silicon, and the supporting substrate, the charge transport layer comprised of hydrogenated amorphous boron.

Figure 5:
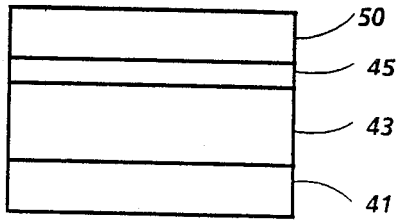

There is illustrated in FIG. 5 a photoresponsive or photoconductive member of the present invention comprised of a supporting substrate 41; a charge transport layer 43 comprised of hydrogenated amorphous boron; a photogenerating layer 45 comprised of photogenerating pigments, inclusive of hydrogenated amorphous silicon; and an overcoating layer 50 inclusive of, for example, those components selected from the group consisting of silicon nitride; preferably with excess silicon, that is nonstoichiometric silicon nitride, silicon carbide, and hydrogenated amorphous carbon. Further, with respect to several of the aforementioned imaging members, there can be added to the photogenerating layer comprised of from, for example hydrogenated amorphous silicon, various substances that will enable the resulting member to be responsive to infrared wavelength energy. Thus, for example, there can be added to the photogenerating hydrogenated amorphous silicon layer up to about 40 atomic percent of germanium.

With further reference to the imaging members of FIGS. 1 to 5, the overcoating layers, which can be comprised of silicon nitride or silicon carbide, may be rendered conductive by fabricating these layers in a manner that a nonstoichiometric composition $SiN_x SiC_y$ results, wherein x is a number of from about 1 to about 1.3, and y is a number of from 0.7 to about 1.3, reference U.S. Pat. No. 4,544,617, the disclosure of which is totally incorporated herein by reference. Moreover, there is included in the present invention photoresponsive imaging members substantially equivalent to those as illustrated with top overcoating layers comprised of silicon nitride, silicon carbide or amorphous carbon doped with about 0.5 percent to about 5 percent of phosphorous or boron, which doping renders the overcoatings partially conductive enabling the further enhancement of image quality. In addition, the hydrogenated amorphous carbon, or halogenated amorphous silicon layers can include therein dopants, either of the p or n variety. These dopants are present in an amount of from, for example, 1 part per million to about 1,000 parts per million.

In regard to the imaging members of the present invention, particularly those imaging members illustrated in the Figures, there can be selected halogenated amorphous boron as a replacement for the hydrogenated amorphous boron. Examples of halogenated components include fluorine and chlorine. Also, certain unhydrogenated amorphous boron may be useful providing the objectives of the present invention are achievable.

The supporting substrates for each of the photoresponsive devices illustrated herein may be opaque or substantially transparent, and are comprised of various suitable materials having the requisite mechanical properties. Thus, the substrate can be comprised of numerous substances providing the objectives of the present invention are achieved. Specific examples of substrates are insulating materials such as inorganic or organic polymeric compositions; a layer of an organic or inorganic material having a semiconductive surface layer thereon, such as indium tin oxide; or a conductive material such as, for example, aluminum, chromium, nickel, brass, stainless steel, or the like. The substrate may be flexible or rigid, and can have many different configurations inclusive of, for example, a plate, a cylindrical drum, a scroll, an endless flexible belt, and the like. Preferably, the substrate is in the form of a cylindrical drum or endless flexible belt. In some situations, it may be desirable to coat on the back of the substrate, particularly when the substrate is an organic polymeric material, an anticurl layer such as, for example, polycarbonate materials commercially available as Makrolon.

Further, the thickness of the substrate layer depends on many factors including economical considerations, and the mechanical properties desired. Accordingly, for example, thus this layer can be of a thickness of from about 0.01 inch (254 microns) to about 0.2 inch (5,080 microns); and preferably is of a thickness of from about 0.05 inch (1,270 microns) to about 0.15 inch (3,810 microns). In one embodiment, the supporting substrate is comprised of oxidized nickel in a thickness of from about 1 mil to about 10 mils.

One important component for the imaging members of the present invention is the hydrogenated or halogenated amorphous boron. Therefore, hydrogenated amorphous boron with from about 5 to 30 atomic percent hydrogen; and halogenated amorphous boron with from about 5 to 30 percent of halogen, useful in the present invention and possessing photogenerating and hole transporting characteristics can, for example, be obtained by a hybrid technique combining dc glow discharge decomposition with sputtering of pure boron in a mixture of diborane and an inert gas such as argon. This component can also be produced by the rf flow discharge decomposition of diborane. Additionally, controlled hydrogenation can be achieved by introducing molecular or atomic hydrogen during the process. Hydrogenated or halogenated amorphous boron useful in the present invention can also be prepared by known glow discharge decomposition processes. Moreover, in those embodiments where there is desired a photoresponsive imaging member that is sensitive to infrared radiation, there is provided hydrogenated amorphous boron with a band gap of from about 1 to about 2 electron volts.

Specifically therefore, hydrogenated or halogenated amorphous boron with photoconductive properties can be prepared by a glow discharge or plasma deposition of diborane gases. In one specific embodiment, the process of preparation involves providing a receptacle containing therein a first substrate electrode means and a counterelectrode means; providing a cylindrical surface on the first electrode means; heating the cylindrical surface with heating elements contained in the first electrode means while causing the first electrode means to rotate; introducing into the reaction vessel a source of amorphous boron, such as diborane gas at right angles with respect to the cylindrical member; applying a voltage between the first electrode means; and providing a current to the second electrode means, wherein the diborane gas is decomposed resulting in the deposition of hydrogenated amorphous boron with a band gap of from about 1.0 to about 3 electron volts, on the cylindrical surface. The diborane gas is permitted to flow through the reaction chamber to provide the amorphous boron photoconductive substance. For example, from about 100 sccm to about 1,000 sccm of methane or ethane gas flows through the reaction chamber. The aforementioned gases can then be decomposed by the action of a radio frequency (rf) or a direct current (dc) electric field thereby creating condensable radicals. These radicals recombine on the surfaces of the electrodes to enable the formulation of the photoconductive amorphous boron film. Moreover, the hydrogen or halogen content can be controlled by various process conditions inclusive of the amount of electrical power conveyed to the electrodes; the flow rate of the gases selected; the composition of the precursor gas or gases; the pressure selected during decomposition; and other similar reaction parameters. Further, by carefully selecting the process parameters, including high electrical power, high substrate temperatures, and low pressures, there can be obtained amorphous boron possessing low band gaps with relatively little hydrogen content. Generally, however, the amorphous boron contains from about 5 atomic percent of hydrogen, to about 30 atomic percent or greater providing the objectives of the present invention are achievable.

The process and apparatus useful for preparing the photoresponsive imaging members of the present invention are specifically disclosed in U.S. Pat. No. 4,466,380, the disclosure of which is totally incorporated herein by reference. Generally, the apparatus disclosed in the aforementioned patent is comprised of a rotating cylindrical first electrode means 3 secured on an electrically insulating rotating shaft; radiant heating element 2 situated within the first electrode means 3; connecting wires 6; a hollow shaft rotatable vacuum feedthrough 4; a heating source 8; a hollow drum substrate 5 containing therein the first electrode means 3, the drum substrate being secured by end flanges which are part of the first electrode means 3; a second hollow counterelectrode means 7 containing flanges thereon 8; and slits or vertical slots 10 and 11; receptacle or chamber means 15 containing as an integral part thereof receptacles 17 and 18 for flanges 9 for mounting the module in the chamber 15; a capactive vacuum sensor 23; a guage 25; a vacuum pump 27 with a throttle valve 29; mass flow controls 31; a gauge and set point box 33; gas pressure vessels 34, 35 and 36, for example; pressure vessel 34 containing, for example, methane gas; pressure vessel 35 with phosphine gas; and 36 containing, for example, diborane gas; a current source means 37 for the first electrode means 3; and a second counterelectrode means 7. The chamber 15 contains an entrance means 19 for the source gas material and an exhaust means 21 for the unused gas source material. Generally, in operation the chamber 15 is evacuated by vacuum pump 27 to appropriate low pressures. Subsequently, for example, a diborane gas originating from vessel 36 is introduced into the chamber 15 through entrance means 19, the flow of the gases being controlled by the mass flow controller 31. This gas is introduced into the entrance 19 in a cross-flow direction, that is, the gas flows in the direction perpendicular to the axis of the cylindrical substrate 15 contained on the first electrode means 3. Prior to the introduction of the aforementioned gas, the first electrode means is caused to rotate by a motor and power is supplied to the radiant heating elements 2 by heating source 8, while voltage is applied to the first electrode means and the second counterelectrode means by a power source 37. Generally, sufficient power is applied from the heating source 8 that will maintain the drum 5 at a temperature ranging from about 100° C. to about 300° C., and preferably at a temperature of about 200° C. to 250° C. The pressure in the chamber 15 is automatically regulated so as to correspond to the settings specified at gauge 25 by the position of throttle valve 29. The electrical field created between the first electrode means 3 and the second counterelectrode means 7 causes the diborane gas to be decomposed by glow discharge whereby amorphous boron containing about 5 to about 30 atomic percent of hydrogen is deposited in a uniform thickness on the surface of the cylindrical means 5 contained on the first electrode means 3.

In one preferred embodiment, the hydrogenated amorphous boron photoconductive component with a band gap of 1.0 to 3 electron volts can be prepared by introducing into the reaction chamber diborane or decaborane gas at a rate of 200/sccm in accordance with the details as illustrated in U.S. Pat. No. 4,466,380, the disclosure of which has previously been totally incorporated herein by reference. More specifically, the reaction chamber selected is maintained at room temperature, and radio frequency power of 100 watts is applied to the rotating cylindrical electrode permitting the gas to emit light; and partially decompose at pressures of 750 milliTorr. The aforementioned process is continued for about three hours and the anodic and cathodic films deposited on the counterelectrode and the cylindrical drum, respectively, are removed from the chamber. Band gap measurements of these films by optical methods indicate the anodic and cathodic films are substantially different in their characteristics. Thus, for example, the anodic film possesses a band gap of about 3, electron volts while the cathodic film of hydrogenated amorphous boron has a band gap of 1 electron volt.

The overcoatings of silicon nitride or silicon carbide can also be prepared, reference U.S. Pat. No. 4,544,617, by the glow discharge deposition of mixtures of silane and ammonia or nitrogen gases, or silane and a hydrocarbon gas such as methane in the apparatus as described in the aforementioned patent. Amorphous carbon is deposited as an overcoating in a similar manner with the exception that there is selected for the glow discharge apparatus a hydrocarbon gas such as methane.

Specific examples of gases that can be selected for generating the hydrogenated amorphous photoconductive borons of the present invention include, for example, diborane, $B_2H_6$, triborane $B_3H_8$, decaborane $B_{10}H_{14}$, and the like. Additionally, mixtures of the aforementioned gases can be selected, for example, from about 5 percent to about 90 percent by volume of diborane gas, and from about 95 percent to about 10 percent by volume of decaborane gas. Other gases not specifically mentioned herein may be selected providing the objectives of the present invention are achievable.

Photoconductive hydrogenated amorphous boron can also be prepared as illustrated in U.S. Pat. No. 4,376,688 and 4,416,755, the disclosures of which are totally incorporated herein by reference. Specifically, there is disclosed in these patents a process for preparing amorphous silicon films on a substrate which involves a means for directing and accelerating an ion beam from a plasma toward a sputtering target contained within a chamber, which chamber also contains a shield means having a low sputtering efficiency compared to the sputtering target. The shield means is situated between stray ion beams and a vacuum chamber surface. More specifically, the ion beam process for generating hydrogenated amorphous carbon involves generating a plasma of hydrogen gas; directing and accelerating an ion beam of the plasma toward a boron sputtering target present in a vacuum chamber at reduced pressures; shielding the vacuum surface from stray ion beams by boron shields whereby sputtering of the vacuum chamber surface by the plasma is minimized; sputtering the target of boron with the ion beam; and collecting the sputtered target material as a film of amorphous boron on a substrate which is physically isolated from the plasma generating process and the sputtering process.

Alternatively, hydrogenated or halogenated amorphous boron photoconductive substances and imaging members thereof can be prepared by a sputtering technique wherein a substrate is attached to one electrode and a target comprised of a source of boron is placed on a second electrode. These electrodes are connected to a high voltage power supply, and a gas which can be a mixture of argon and hydrogen is introduced between the electrodes to provide a medium in which a glow discharge or plasma can be initiated and maintained. The glow discharge provides ions which strike the boron target and cause the removal by momentum transfer of mainly neutral target atoms which subsequently condense as a thin film on the substrate electrode. Also, the glow discharge functions to activate the hydrogen causing it to react with the source of boron and to be incorported into the deposited amorphous boron film. The activated hydrogen also coordinates with the dangling bonds of the amorphous boron. Other methods of preparation include the known rf sputtering and dc sputtering processes. Further, there can be selected for obtaining the imaging members of the present invention with photoconductive amorphous boron direct ion beam deposition. The deposition apparatus selected for direct ion beam deposition is substantially similar to that used for the ion beam sputter deposition processes. One major difference resides in the selection of a dihydroboron or fluoroboron gas rather than an inert gas/hydrogen mixture in the plasma ion gun.

With further reference to the photoresponsive imaging members of the present invention, the photogenerator/charge transport layers are of a thickness of from about 1 to about 25 microns; however, other thicknesses may be selected provided the objectives of the present invention are accomplished. Additionally, with regard to those members wherein a photogenerating layer such as hydrogenated, with from about 10 to about 40 atomic percent of hydrogen, amorphous silicon is selected, this layer is of a thickness of from about 0.5 microns to about 5 microns. Moreover, when the photoresponsive imaging members of the present invention include therein a photogenerating layer, and as a charge transport layer the hydrogenated amorphous boron illustrated herein, the transport layer is of a thickness of from about 1 to about 25 microns. Additionally, the overcoatings selected are of a thickness of from about 200 nanometers to about 1 micrometer.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

A hydrogenated amorphous boron photoreceptor can be fabricated with the apparatus and process conditions as illustrated in U.S. Pat. No. 4,466,380, the disclosure of which has been totally incorporated herein by reference. Thus, an aluminum drum substrate 15 inches long with an outer diameter of 3.3 inches can be inserted over a mandrel contained in the vacuum chamber of the aforementioned patent at a pressure of less than $10^{-4}$ Torr. The drum and mandrel are then rotated at 5 revolutions per minute, and subsequently 200 sccm of diborane gas is introduced into the vacuum chamber. The pressure is maintained at 100 milliTorr by an adjustable throttle valve. A d.c. voltage of −1,000 volts is then applied to the aluminum drum with respect to the electrically grounded counterelectrode which has a diameter of 4.8 inches, a gas inlet and exhaust slot of 0.5 inch wide, and is of a length of about 16 inches. After 3 hours, the voltage to the mandrel is disconnected, and the gas flow is terminated. Thereafter, the drum obtained is removed from the vacuum chamber. There is thus obtained an imaging member comprised of aluminum in a thickness of about 5 mils, and a hydrogenated amorphous boron layer with a thickness of about 15 microns.

The resulting photoresponsive imaging member is then incorporated into a xerographic imaging apparatus commercially available as the Xerox Corporation 3100® wherein images are generated at electric fields of 20 volts per micron. Thereafter, these images can be developed with a toner composition consisting of a styrene n-butyl methacrylate copolymer, 90 percent by weight, and carbon black particles, 10 percent by weight.

EXAMPLE II

A photoresponsive imaging member is prepared by repeating the procedure of Example I with the exception that there is initially deposited on the aluminum drum hydrogenated amorphous silicon in a thickness of about 0.5 micron by first introducing into the reaction chamber a silane gas, reference U.S. Pat. No. 4,466,380, the disclosure of which has been previously totally incorporated herein by reference. Subsequently, there is deposited in a thickness of 25 microns on the amorphous silicon at a pressure of 1 Torr, hydrogenated, 25 atomic percent hydrogen, amorphous boron at a power level of 0.01 watts/centimeters$^2$. The combined flow rate of the gases is 500 sccm. In about two hours there is formed an amorphous hydrogenated boron layer.

The resulting photoresponsive imaging member can then be incorporated into a xerographic imaging apparatus commercially available as the Xerox Corporation 3100® wherein images are generated at electric fields of 20 volts per micron. Thereafter, these images can be developed with a toner composition consisting of a styrene n-butyl methacrylate copolymer and carbon black particles.

EXAMPLE III

A photoresponsive imaging member is prepared by repeating the procedure of Example I with the exception that there is introduced into the vacuum chamber 200 sccm of decaborane gas containing 1 percent by weight of diborane, and the pressure is maintained at 200 milliTorr rather than 100 milliTorr. Also, there is selected a radio frequency voltage with 0.01 watt/centimeters$^2$, instead of a d.c. voltage of −1,000 volts.

The resulting photoresponsive imaging member can then be incorporated into a xerographic imaging apparatus commercially available as the Xerox Corporation 3100® wherein images are generated at electric fields of 20 volts per micron. Thereafter, these images can be developed with a toner composition consisting of a styrene n-butyl methacrylate copolymer, 90 percent by weight, and carbon black particles, 10 percent by weight.

EXAMPLE IV

A photoresponsive imaging member is prepared by repeating the procedure of Example III with the exception that there is added a mixture of diborane and argon gases.

There can also be prepared photoresponsive imaging members with photogenerating layers of hydrogenated amorphous silicon, and charge transport layers of hydrogenated amorphous boron in accordance with the process parameters as illustrated herein; and particularly the copending applications and U.S. patents as indicated, the disclosures of which have been totally incorporated herein by reference. Similarly, imaging members with overcoating layers of silicon nitride, silicon carbide, or amorphous carbon can be formulated in accordance, for example, with the description of U.S. Pat. No. 4,544,617, the disclosure of which is totally incorporated herein by reference.

Although the invention has been described with reference to specific preferred embodiments, it is not intended to be limited thereto; rather those skilled in the art will recognize variations and modifications may be made therein which are within the spirit of the present invention and within the scope of the following claims.

What is claimed is:

1. A photoresponsive imaging member comprised of a single photogenerating layer
   of hydrogenated amorphous boron with a band gap of from about 1 to about 3 electron volts, or halogenated amorphous boron with a band gap of from about 1 to about 3 electron volts.

2. A photoresponsive imaging member in accordance with claim 1 wherein the halogenated amorphous boron has a band gap of from about 1 to about 3 electron volts.

3. A photoresponsive imaging member in accordance with claim 1 wherein there is selected a mixture of hydrogenated amorphous boron and halogenated amorphous boron.

4. A photoresponsive imaging member in accordance with claim 1 further including therein a supporting substrate.

5. A photoresponsive imaging member in accordance with claim 4 further including therein a supporting substrate and in contact therewith hydrogenated and/or halogenated amorphous boron with a band gap of from about 1 to about 3 electron volts.

6. A photoresponsive imaging member in accordance with claim 5 wherein the hydrogenated amorphous boron has a band gap of from about 1.4 to about 3 electron volts.

7. A photoresponsive imaging member in accordance with claim 5 wherein the supporting substrate is aluminum.

8. A photoresponsive imaging member in accordance with claim 5 wherein the amorphous boron has a ratio of 80 percent by weight of single bonds linking the boron atoms, and 20 percent by weight of double bonds linking the boron atoms.

9. A photoresponsive imaging member comprised of a single photogenerating layer of a supporting substrate, amorphous boron selected from the group consisting of hydrogenated amorphous boron and halogenated amorphous boron each with a band gap of from about 1 to about 3 electron volts.

10. A photoresponsive imaging member in accordance with claim 9 wherein the amorphous boron is of a band gap of from 1 to about 3 electron volts.

11. A photoresponsive imaging member in accordance with claim 9 wherein the overcoating layer is comprised of amorphous carbon.

12. A photoresponsive imaging member in accordance with claim 9 wherein the overcoating is silicon nitride or silicon carbide.

13. A photoresponsive imaging member comprised of a supporting substrate, a photogenerating layer of amorphous boron, and an overcoating layer wherein the amorphous boron is present in a transitional gradient with from about 10 atomic percent to about 30 atomic percent of hydrogen present in a direction from the supporting substrate to the interface situated between the amorphous boron photoconductive layer and the overcoating layer.

14. A photoresponsive imaging member in accordance with claim 13 wherein the amorphous boron is of a band gap of from 1 to about 3 electron volts.

15. A photoresponsive imaging member in accordance with claim 13 wherein the overcoating is comprised of silicon nitride, silicon carbide, or amorphous carbon.

16. A photoresponsive imaging member comprised of a photogenerating hydrogenated amorphous boron layer with a band gap of from about 1 to about 3 electron volts, and in contact therewith a photogenerating layer of hydrogenated amorphous silicon wherein said layer is of a thickness of from about 5 to about 25 microns and contains from about 5 to about 30 atomic percent of hydrogen.

17. A photoresponsive imaging member in accordance with claim 16 wherein there is further included therein a supporting substrate.

18. A photoresponsive imaging member in accordance with claim 16 wherein the amorphous boron has a band gap of 2 electron volts.

19. A photoresponsive imaging member in accordance with claim 16 wherein the photogenerating layer is comprised of an amorphous hydrogenated silicon and germanium alloy.

20. A photoresponsive imaging member in accordance with claim 16 wherein the photogenerating layer is doped with phosphorous or boron.

21. A photoresponsive imaging member in accordance with claim 16 wherein the amorphous silicon photogenerating layer is situated between a supporting substrate and the amorphous boron layer.

22. A photoresponsive imaging member in accordance with claim 16 wherein the amorphous boron layer is situated between the amorphous silicon photogenerating layer and a supporting substrate, and the member further includes thereover an overcoating layer.

23. A photoresponsive imaging member in accordance with claim 1 wherein hydrogen is present in an amount of from about 1 atomic percent to about 30 atomic percent.

24. A photoresponsive imaging member in accordance with claim 3 wherein hydrogen is present in an amount of from about 5 atomic percent to about 30 atomic percent.

25. A photoresponsive imaging member in accordance with claim 4 wherein hydrogen is present in an amount of from about 5 atomic percent to about 30 atomic percent.

26. A photoresponsive imaging member in accordance with claim 5 wherein hydrogen is present in an amount of from about 5 atomic percent to about 30 atomic percent.

27. A method of imaging which comprises generating a latent electrostatic image on the photoresponsive imaging member of claim 1; subsequently developing this image; and transferring the developed image to a suitable substrate.

28. A method of imaging in accordance with claim 32 wherein the photoresponsive imaging member is comprised of fluorinated amorphous boron.

29. A method of imaging in accordance with claim 27 wherein the photoresponsive imaging member is comprised of a mixture of amorphous hydrogenated boron and amorphous halogenated boron.

30. A method of imaging in accordance with claim 27 wherein the imaging member is comprised of a supporting substrate, and in contact therewith hydrogenated and/or fluorinated amorphous boron with a band gap of from about 1.4 to about 3 electron volts.

31. A method of imaging in accordance with claim 27 wherein there is further included in the imaging member a photogenerating layer of amorphous silicon.

32. A method of imaging in accordance with claim 27 wherein the selected supporting substrate is aluminum.

33. A photoresponsive imaging member consisting essentially of a supporting substrate, a photogenerating charge transport layer comprised of hydrogenated amorphous boron of from about 5 to about 30 atomic percent of hydrogen or halogen, which layer is with a thickness of from about 5 to about 25 microns; and wherein said hydrogenated amorphous boron or halogenated amorphous boron has a band gap of from about 1 to about 3 electron volts.

34. A photoresponsive imaging member in accordance with claim 33 wherein the band gap is about 2 electron volts.

35. A photoresponsive imaging member consisting essentially of a supporting substrate, a photoconductive layer comprised of hydrogenated amorphous boron or halogenated amorphous boron in a thickness of from about 5 to about 25 microns, each with a band gap of from about 1 to about 3 electron volts; and wherein the hydrogen or halogen is present in a gradient in an amount of from 0 percent in close proximity to supporting substrate, and extending to an amount of about 30 percent at the interface between the photoconductive layer.

36. A photoresponsive imaging member in accordance with claim 35 wherein the hydrogen or halogen is present in an amount of from about 5 to about 15 atomic percent.

37. A photoresponsive imaging member in accordance with claim 33 wherein the thickness of the hydrogenated amorphous boron or halogenated amorphous boron layer is from about 5 to about 25 microns.

* * * * *